United States Patent [19]

Scott et al.

[11] Patent Number: 4,711,744

[45] Date of Patent: Dec. 8, 1987

[54] STARTING AID FOR SMALL INTERNAL COMBUSTION ENGINES

[75] Inventors: William A. Scott, Mt. Zion; Carl Dull, Decatur, both of Ill.

[73] Assignee: Tillotson, Ltd., Tralee, Ireland

[21] Appl. No.: 848,409

[22] Filed: Apr. 4, 1986

[51] Int. Cl.[4] ..... F02M 1/14

[52] U.S. Cl. ..... 261/64.4; 261/64.6; 123/179 G

[58] Field of Search ..... 261/64.4, 64.6; 123/179 G

[56] References Cited

U.S. PATENT DOCUMENTS

| | | | |
|---|---|---|---|
| 909,897 | 1/1909 | Hertzberg | 123/179 G |
| 1,003,994 | 9/1911 | Dennis | 261/64 C |
| 1,019,160 | 3/1912 | Ivor | 261/54 |
| 1,131,584 | 3/1915 | Wildy . | |
| 1,179,381 | 4/1916 | Sunderman . | |
| 1,194,297 | 8/1916 | Kingston | 261/64 C |
| 1,324,515 | 12/1919 | Otti | 261/64 C |
| 1,346,201 | 7/1920 | Hays | 261/64 C |
| 1,379,474 | 5/1921 | Osborne . | |
| 2,913,233 | 1/1957 | Powell et al. . | |
| 3,625,492 | 12/1971 | Reichenbach et al. . | |
| 3,698,367 | 10/1972 | Goodwin . | |
| 3,738,608 | 6/1973 | Nutten et al. | 261/DIG. 68 |
| 3,939,231 | 2/1976 | Steele et al. . | |
| 4,123,233 | 10/1978 | Mannino . | |

FOREIGN PATENT DOCUMENTS

| | | | |
|---|---|---|---|
| 2342865 | 2/1974 | Fed. Rep. of Germany . | |
| 551039 | 12/1922 | France | 261/64 E |
| 162496 | 5/1921 | United Kingdom | 261/64 E |

*Primary Examiner*—Tim Miles

*Attorney, Agent, or Firm*—Harness, Dickey & Pierce

[57] ABSTRACT

A choke assembly or starting aid for small internal combustion engines is disclosed. An inertia valve is resiliently biased in the bore of the engine. The inertia valve is responsive to vibration of the internal combustion engine for providing a controlled amount of combustion air into the carburetor of the internal combustion engine.

4 Claims, 4 Drawing Figures

STARTING AID FOR SMALL INTERNAL COMBUSTION ENGINES

BACKGROUND AND SUMMARY OF THE INVENTION

The present invention relates to chokes or starting aids for small internal combustion engines and more particularly, to a choke or starting aid which is responsive to the vibration of the internal combustion engine upon start-up of the engine.

When starting small internal combustion engines, it is usually necessary to pull on the starter rope several times before the engine kicks over and begins to run. Generally, after a couple of pulls on the starter rope the engine starts and runs for a short period of time and then stops. This is what is commonly known in the field as a "false start". This "false start" phenomenon has been present in the chain saw art for several years and has come to be accepted by the users of such saws as an acceptable starting method. The user generally has knowledge of the fuel system procedure and understands why the system is not starting.

The difficulty in starting a cold small internal combustion engine centers around the choke system of these particular engines. When the choke system is in a closed position, the fuel line system of the cold engine has a very high restriction in the air intake. This restriction of the air intake forms a vacuum in the fuel line, sucking fuel into the engine via the carburetor from the fuel tank. As the starting rope is pulled, the engine sucks fuel into the carburetor by the vacuum created in the system. As the engine begins to fire, a certain amount of air is necessary to keep the engine running. With a manual choke, the user must open the choke quickly after the engine begins running or the user will experience the "false start" phenomenon. The reason for the "false start" is that as the speed of the engine increases, the engine sucks more fuel. With the choke in a closed position however, the amount of air flow entering the engine is not increased. Thus, a proper mixture of air and fuel is not achieved and the engine dies instantly. Also, if the engine does not start up, a substantial amount of fuel is sucked into the engine, via the carburetor causing the engine and carburetor to become flooded, further hampering the starting procedure of the engine.

Choke devices presently used in the field are of the butterfly type. These types of chokes are pivotally secured in the carburetor air port of an internal combustion engine. The choke usually pivots about a central axis, flipping from a closed to an open position. This type of choke assembly has several disadvantages. The choke is either in a fully closed or a fully open position. When starting the engine the choke is in the fully closed position. Once the engine starts, it is nearly impossible to rotate the choke to its open position, so that the engine will continue to run. Also, the butterfly valve may slip from a closed to an open position without notice to the user. This slippage is due to the fact that, in many instances, there is no resistance member holding the butterfly valve in position. Those skilled in the art are aware of yet other disadvantages of this type of choke assembly.

Accordingly, it is an object of the present invention to overcome the disadvantages of the above art. The present invention provides the art with a new and improved choke assembly which enables air to automatically enter the carburetor during the start-up of an internal combustion engine for providing a continuous running situation. The present invention includes a resilient biasing member for securing the choke assembly in place against slippage. Further, the present invention utilizes the vibration of the small internal combustion engine during start-up for enabling air to enter into the carburetor of the engine at start-up.

The new and improved choke assembly of the present invention provides the art with a semi-automatic choke or starting aid. The choke assembly generally is for small internal combustion engines having a carburetor with an air port in communication with the carburetor and combustion air. Also, a bore, through the carburetor, is in communication with the piston cylinder of the internal combustion engine. The choke of the present invention includes a mechanism for controlling an amount of combustion air entering the carburetor. The mechanism includes an inertia valve member positioned in the inlet air manifold for selectively controlling the amount of combustion air entering into the carburetor. A resilient biasing member, secured in the inlet air manifold, resiliently secures the inertia valve member in the inlet air manifold. The inertia vlave member and biasing member are responsive to the vibration of the internal combustion engine for controlling the amount of combustion air entering into the carburetor.

Generally, the inlet air manifold is coupled with a seating member which provides a seating surface for the interia valve in the manifold. The seating member has an aperture for metering the amount of air which enters into the carburetor. Also, the aperture provides the seating surface for the inertia valve member.

From the subsequent description and the appended claims taken in conjunction with the accompanying drawings, other objects and advantages of the present invention will become apparent to one skilled in the art.

DETAILED DESCRIPTION OF THE PREFERRED EMBODIMENT

Figure 1:
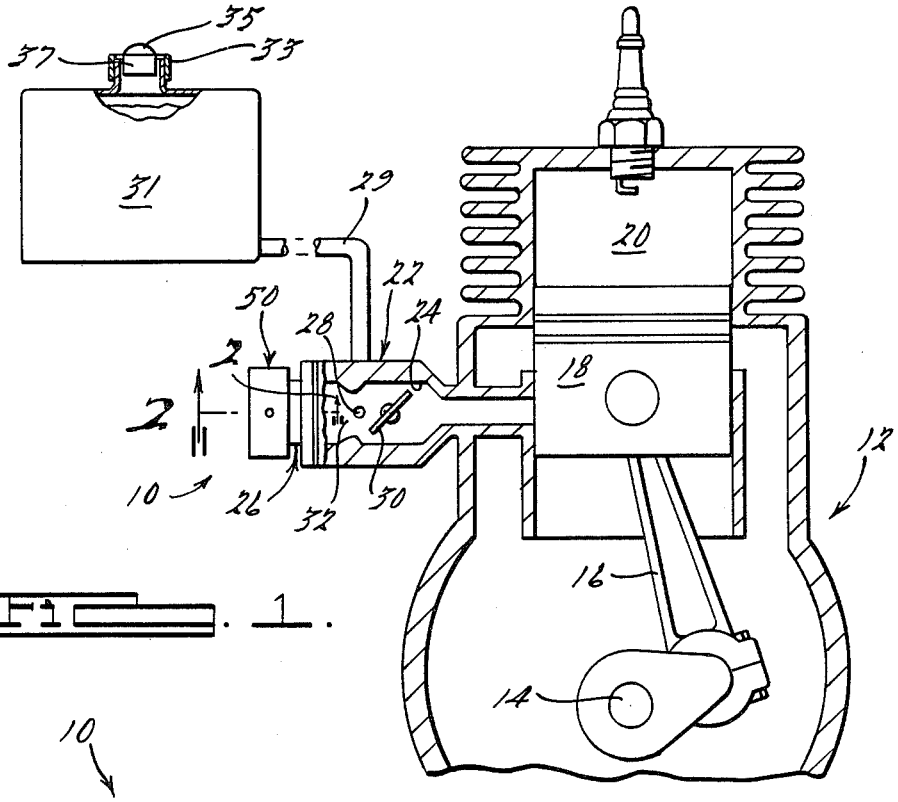
FIG. 1 is a cross-sectional view of a small internal combustion engine having a choke or starting aid in accordance with the present invention.
Figure 2:
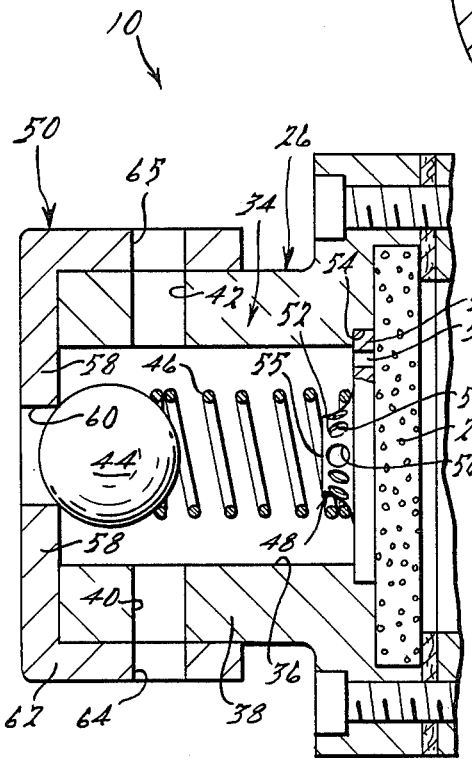
FIG. 2 is an enlarged view of the choke or starting aid of FIG. 1.

Referring to FIGS. 1 and 2, a choke assembly or starting aid is shown and is designated with the reference numeral 10. As best seen in FIG. 1, the choke assembly 10 is coupled with an internal combustion engine 12. The internal combustion engine 12 includes a crankshaft 14 having a piston rod 16 secured to it. The piston rod 16 has a piston head 18 which is slidably positioned in a piston cylinder 20 in the internal combustion engine 12. A carburetor 22, coupled with the internal combustion engine 12, is in communication with the piston cylinder 20 via a carburetor bore 24. The carburetor 22 provides a combustionable air/fuel mixture to the piston cylinder 20 for driving the internal combustion engine 12. The carburetor 22 is in communication with an inlet air manifold 26 which, in turn, is in communication with a source of combustion air, preferably atmospheric air. The choke assembly 10 is generally positioned in the inlet air manifold 26 of the carburetor 22 of the internal combustion engine 12, as best seen in FIGS. 1 and 2.

The carburetor 22 generally has a fuel inlet port 28 for providing fuel to the piston cylinder 20 for combustion in the piston cylinder 20. The carburetor 22 also has a throttle valve 30 for controlling the amount of air/fuel mixture which enters into the piston cylinder 20. The throttle valve 30 is pivotally positioned in the carburetor bore 24. A venturi 32 is formed in the carburetor bore 24 for enabling the air/fuel mixture to move more rapidly into the piston cylinder 20.

The inlet air manifold 26 is generally adjacent to and in communication with the carburetor bore 24. Combustion air is drawn through the inlet air manifold 26 for supplying combustion air into the piston cylinder 20 via the carburetor 22. Generally, the inlet air manifold 26 is formed of a projecting member 34 which is secured to the carburetor 22 by conventional means. The projecting member 34 has a bore 36 through the projecting member 34 enabling air to pass through the inlet air manifold 26. The projecting member 34 includes a continuous wall 38 defining the bore 36. The wall 38 has at least one, preferably two or more, apertures 40 and 42 in the wall 38 in communication with the bore 36. The apertures 40 and 42 enable combustion air to enter the carburetor 22, while bypassing the choke assembly 10, when the internal combustion engine is beyond the start-up condition.

The choke assembly 10 includes an inertia valve member 44 positioned in the inlet air manifold 26, a biasing member 46 securing the inertia valve member 44 in the inlet air manifold 26, a retaining member 48 for retaining the biasing member 46 in the inlet air manifold 26, and a manually rotatable seating member 50 for seating the interia valve member 44 in the inlet air manifold 26.

The interia valve member 44 is preferably a spherical member secured in the inlet air manifold 26 by the biasing member 46. The valve member 44, however, can be of any geometry with a mass or weight which reacts to vibration. The inertia valve member 44 responds to the vibration of the internal combustion engine 12. The valve member 44 vibrates off of the seat member 50 during start-up to enable combustion air to enter into the inlet air manifold 26 and provide a controlled amount of combustion air at start-up.

The biasing member 46 is preferably a helical spring. The biasing member 46 has a diameter such that the spherical inertia valve member 44 seats on one end of the biasing member 46. A spring constant is predetermined for the biasing member 46 so that when the internal combustion engine 12 is started the vibration of the engine 12 enables the biasing member 46 to compress enabling the inertia valve 44 to move away from the seat member 50 permitting air to enter into the inlet air manifold 26. The predetermined spring constant of the biasing member 46 also enables the biasing member 46, in a resting position, to firmly seat the inertia valve member 44 against the seat member 50.

The retaining member 48 preferably has a projecting member 52 for securing one end of the biasing member 46 onto the retaining member 48. The projecting member 52 has an aperture 55 through it for allowing combustion air to pass through the retaining member 48. The retaining member 48 is positioned in a groove 54 in the bore 36 of the wall 38 of the projecting member 34 for securing the retaining member 48 in the bore 36 of the projection member 34. The retaining member 46 also includes a plurality of apertures 56 and 59 about its projecting member 52 and flange portion 57 for enabling air to pass through the retaining member 48.

A foam filter 25 is positioned adjacent to the retaining member 48. The filter 25 traps and prevents inpurities in the combustion air from entering into the carburetor 22. The filter 25 may be removed and cleaned or replaced as needed.

The seating member 50 generally has a planar surface 58 covering the free depending end of the projecting member 34. The planar member 58 has an aperture 60 through it for seating the inertia valve member 44 in the aperture 60. The seating member 50 has a continuous wall 62 depending from the planar member 58 which surrounds a portion of projecting member 34. The seating member 50 has an overall cap shape. The depending wall 62 has at least one aperture 64, and preferably two or more apertures, for aligning with apertures 40 and 42 when seating member 50 is positioned in the open-choke position for enabling air to bypass the inertia valve member 44 when the internal combustion engine 12 is beyond the start-up condition. This alignment provides the choke assembly 10 with an open position which enables combustion air to bypass the inertia valve member 44.

Figure 3:
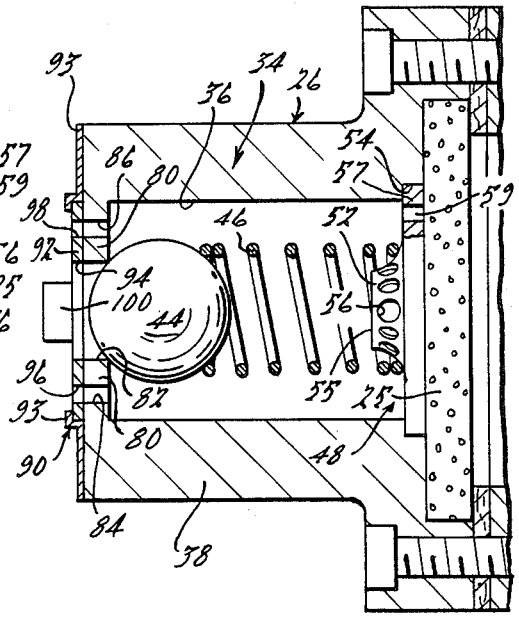
FIG. 3 is a cross-sectional view similar to FIG. 2 of an alternative embodiment of a choke or starting aid in accordance with the present invention.

FIG. 3 illustrates a second embodiment of the present invention. The previously discussed elements that are common between the disclosed embodiment will be designated with the same reference numerals.

FIG. 3 shows the projecting member 34. The wall 38 of the projecting member 34 has a flange 80 extending into the bore 36 and defining an aperture 82. The aperture 82 functions the same as the seating aperture 60 as described herein. Also, a pair of apertures 84 and 86 are in the flange 80. The apertures 84 and 86 function the same as apertures 40 and 42 as described herein.

A seating member 90 having an annular shaped planar body 92 is rotatably secured to the flange 80 via an annular element 93 which is nonrotatably secured to the flange 80 by a conventional fastening means. The body 92 has an aperture 94 aligned with aperture 82 for enabling combustion air to enter into the carburetor during start-up. The body 92 has a pair of smaller apertures 96 and 98, which function the same as apertures 64 and 65 described herein, which align with apertures 84 and 86 for enabling combustion air to bypass the inertia valve 44 when the choke assembly is in an off position. The body 92 has at least one projecting tab 100 for providing a means for easy rotation of the seating member 90. When the seating member 90 is rotated so that apertures 96 and 98 are not in alignment with apertures 84 and 86 the choke assembly is in a closed position. The function of the choke assembly is the same as that disclosed herein for the other embodiment of the present invention.

Figure 4:
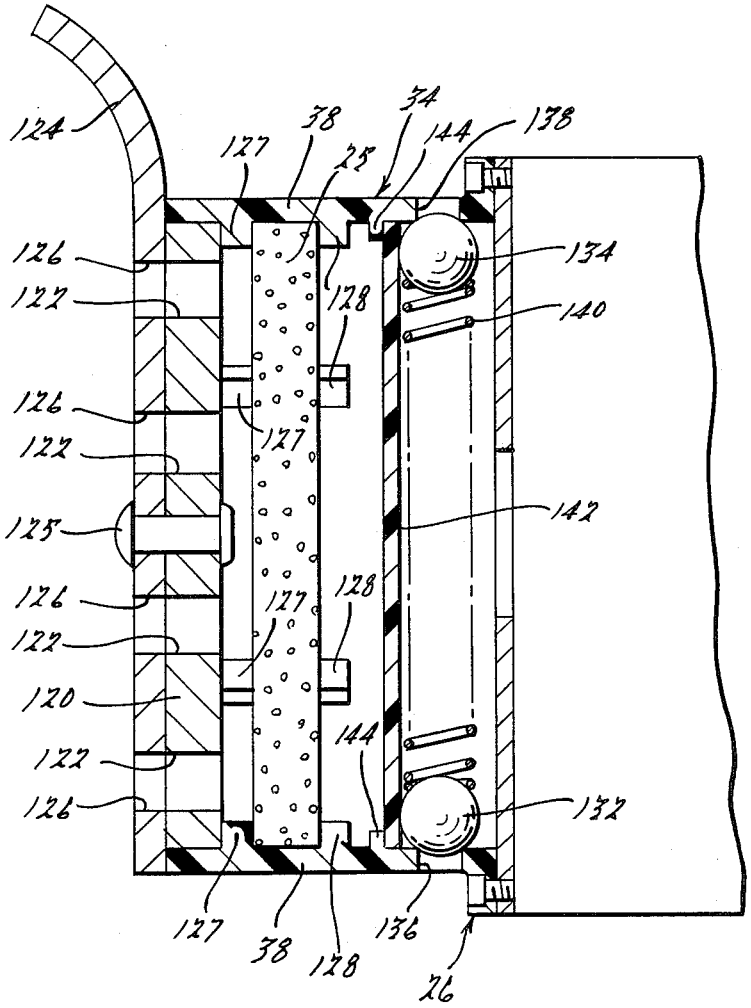
FIG. 4 is a cross-sectional view similar to FIG. 2 of an alternative embodiment of a choke or starting aid in accordance with the present invention.

FIG. 4 illustrates another embodiment of the present invention. The previously discussed elements that are common between the disclosed embodiment will be designated with the same reference numerals.

FIG. 4 shows the projecting member 34 wherein the wall 38 of the projecting member 34 has a continuous top wall 120 having a series of apertures 122. A choke lever 124 is rotatably secured to the top wall 120 to rotate around a pin 125 secured to the top wall 120. The choke lever 124 has at least one aperture 126. Apertures 122 and 126 function the same as apertures 40 and 42, and 64 and 65, respectively, as described herein. The choke lever 124 rotates from an open position as shown, where apertures 122 and 126 are in alignment, to a closed position, not shown, when apertures 122 and 126 are not in alignment.

A foam air filter 25 is positioned in the bore 36 adjacent the top wall 120 by a plurality of ribs 127 and 128. A pair of inertia valve members 132 and 134 are seated on apertures 136 and 138, respectively, in the wall 38 of the projecting member 34. A spring biasing member 140 is positioned between the inertia valve members 132 and 134 for seating the members 132 and 134 in the apertures 136 and 138. The apertures 136 and 138 function the same as seating aperture 60 as described herein. An elongated housing 142 shaped like a tube cut in half axially along its centerline encapsulates the members 132 and 134 and spring biasing member 140 to retain the member 132, 134, and 140 in a proper relative position within the bore 36. The housing 142 is held in place by suitable means, such as by ribs 144. The choke assembly functions in the same general manner as that disclosed herein for the other embodiments of the present invention as described above.

As seen in FIG. 1, the fuel inlet port 28 of each embodiment is coupled with a fuel line 29 which, in turn, is coupled with a fuel tank 31. The fuel tank 31 has a rotatable removable cap 33. As an optional feature, the cap 33 has a primer bulb 35 positioned on the cap 33. The primer bulk 35 is coupled with a one way check valve 37 for enabling air to enter and remain in the fuel tank 31. When the primer bulb 35 is pushed several times against the one way valve 37, air can enter the fuel tank 31 to create a positive pressure in the fuel tank 31.

The disclosed choke assembly works as follows. The apertures 64 and 65 of the seating member 50 are rotated so that the apertures 64 and 65 are not in alignment with the apertures 40 and 42 of the projecting member 34. The inertia valve member 44 is seated in the aperture 62 of the seating member 50. The choke assembly 10 is now in its closed position.

The cold internal combustion engine 12 is started as follows. The choke is positioned in its closed position and the starting rope is pulled to cause the fuel to be sucked through the carburetor 22 due to the vacuum created in the fuel line by the closing of the choke assembly 10. Fuel is sucked through the carburetor 22 into the piston cylinder 20. The pulling on the starter rope causes the piston to begin its upstroke which, in turn, causes the piston to fire. As the piston 30 begins to fire, more fuel is sucked through the carburetor 22 which, in turn, passes the fuel into the piston cylinder 20. If this process continues without sufficient air entering the piston cylinder, the engine will become flooded.

As the engine begins to start, a vibratory shock wave is sent throughout the engine. This shock wave excites the biasing member 46 which, in turn, excites the inertia valve member 44. The biasing member 46 deflects to permit the inertia valve member 44 to disengage from its seating engagement with the seating member 50. This disengagement enables a controlled amount of combustion air to enter into the carburetor 22 which, in turn, enables a proper air/fuel mixture to enter into the piston cylinder 20 enabling the engine 12 to continue to run without a "false start".

As the engine continues to run, the inertia valve member 44 continues to vibrate away from the seating member 50 enabling combustion air to continue to enter into the piston cylinder 20. The engine continues to run under this choked condition for several seconds. The user thus has enough time to rotate the seating member 50 so that the apertures 64 of the wall 62 of the seating member 50 are in alignment with the apertures 40 and 42 of the projecting member 34. The choke is now in its open position and combustion air bypasses the inertia valve member 44 and is sucked directly into the carburetor 22 which, in turn, permits the proper air/fuel ratio into the piston cylinder 20.

Thus, the choke of the present invention permits the engine to continuously run under choked conditions for several seconds. This time gives the operator sufficient time to align the apertures of the seating member with the apertures of the projecting member so that continuous running of the engine is accomplished.

While it will be apparent that the preferred embodiment is well calculated to fill the above-stated objects, it will also be appreciated that the present invention is susceptible to modification, variation, alteration and change without varying from the scope and spirit of the present invention.

What is claimed is:

1. An improved choke for small internal combustion engines having a carburetor, a bore operatively associated with the carburetor, the bore having one end in communication with a source of combustion air and another end of the bore in communication with a piston cylinder of the internal combustion engines, said choke comprising:

means coupled with said bore for controlling an amount of combustion air entering the bore, said means including a first member coupled with the combustion air end of said bore for enabling combustion air to enter said bore upon start-up of said engine, an inertia valve means positioned in said bore and associated with said first member for controlling said amount of combustion air entering said bore upon start-up of said engine, a second member coupled with the combustion air end of said bore for enabling combustion air to enter said bore after start-up of said engine, and resilient biasing means for securing in said bore for resiliently securing said inertia valve means in said bore and in association with said first member, wherein said inertia valve means is responsive to vibration of said internal combustion engine to nonlinearly control said amount of combustion air entering said bore subsequent to combustion in said engine.

2. The improved choke according to claim 1 wherein said inertia valve means nonlinearly disassociates with said first member for controlling the amount of combustion air entering said bore upon startup of said engine.

3. An improved choke for small internal combustion engines having a carburetor, a bore operatively associated with the carburetor, the bore having one end in communication with a source of combustion air and another end of the bore in communication with a piston cylinder of the internal combustion engine, said choke comprising:

means coupled with said bore for controlling an amount of combustion air entering the bore, said means including a first member coupled with the combustion air end of said bore for enabling combustion air to enter said bore upon start-up of said engine, an inertia valve means positioned in said bore and associated with said first member for controlling said amount of combustion air entering said bore upon start-up of said engine, a second member coupled with the combustion air end of said bore for enabling combustion air to enter said bore after start-up of said engine wherein said inertia valve means is responsive to vibration of said internal combustion engine such that said inertia valve means responds nonlinearly to control said amount of combustion air entering said bore upon start-up of said engine and remains closed during initial cranking of said engine but quickly opens upon engine combustion and remains open substantially throughout any period of engine combustion.

4. The improved choke according to claim 3 wherein said inertia valve means is seated in an aperture in said first member such that said inertia valve means vibrates in said bore out of seating engagement with said aperture in said first member upon startup of said internal combustion engine for enabling combustion air to enter said bore to control said combustion air entering said bore upon startup of said engine in a nonlinear response.

* * * * *